US012680710B2

(12) United States Patent
Real et al.

(10) Patent No.: US 12,680,710 B2
(45) Date of Patent: Jul. 14, 2026

(54) SYSTEM AND METHOD FOR REMOVING CONDENSATION FROM AIR CONDITIONING UNITS

(71) Applicant: Rheem Manufacturing Company, Atlanta, GA (US)

(72) Inventors: Marcus Joseph Real, San Antonio, TX (US); Peter Iodaci, Jr., Wanaque, NJ (US); Aaron Patrick Gorman, New Braunfels, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 106 days.

(21) Appl. No.: 18/662,111

(22) Filed: May 13, 2024

(65) Prior Publication Data

US 2024/0401830 A1 Dec. 5, 2024

Related U.S. Application Data

(60) Provisional application No. 63/505,220, filed on May 31, 2023.

(51) Int. Cl.
*F24F 11/42* (2018.01)
*F24F 11/61* (2018.01)
*F24F 11/84* (2018.01)

(52) U.S. Cl.
CPC ..... *F24F 11/42* (2018.01); *F24F 11/61* (2018.01); *F24F 11/84* (2018.01)

(58) Field of Classification Search
CPC ..... F24F 13/222; F24F 2013/227; F24F 2013/225; F25B 31/006
See application file for complete search history.

(56) References Cited

U.S. PATENT DOCUMENTS 4,280,334 A * 7/1981 Lakdawala ..... F25B 1/00 62/277
4,406,138 A * 9/1983 Nelson ..... F25D 17/02 62/305
5,682,757 A * 11/1997 Peterson ..... F24F 13/22 62/305
5,699,677 A * 12/1997 Hakala ..... F25D 21/14 62/291
5,979,172 A * 11/1999 Teller ..... F25B 40/02 62/277
7,013,658 B2 * 3/2006 Dobmeier ..... F25D 21/14 62/506
7,284,388 B2 * 10/2007 Yoshida ..... B60H 1/3233 62/291

(Continued)

*Primary Examiner* — Lionel Nouketcha
(74) *Attorney, Agent, or Firm* — Eversheds Sutherland (US) LLP

(57) ABSTRACT

An system is disclosed herein. The system includes a compressor configured to pump a refrigerant in a defrosting mode, a heat exchanging coil configured to receive the refrigerant from the compressor so as to operate in the defrosting mode and melt ice formed on the heat exchanging coil into condensate, a condensate pump, and a water transport system. The condensate pump is configured to pump the condensate via the water transport system. In some instances, a portion of the water transport system is disposed such that residual heat from the compressor heats the condensate being pumped by the condensate pump.

20 Claims, 11 Drawing Sheets

(56) References Cited

U.S. PATENT DOCUMENTS

| | | | | |
|---|---|---|---|---|
| 8,961,708 | B2 * | 2/2015 | Kaiser | F24F 13/222 62/150 |
| 2008/0256975 | A1 * | 10/2008 | Lifson | F25B 1/10 62/509 |
| 2020/0208887 | A1 * | 7/2020 | Mohammad | F25B 39/04 |
| 2020/0400354 | A1 * | 12/2020 | Komiya | F28D 1/05366 |

* cited by examiner

SYSTEM AND METHOD FOR REMOVING CONDENSATION FROM AIR CONDITIONING UNITS

CROSS-REFERENCE TO RELATED APPLICATIONS

This application claims priority to and the benefit of U.S. provisional application No. 63/505,220, filed May 31, 2023, which is hereby incorporated by reference herein in its entirety.

FIELD

This disclosure relates generally to air conditioning units and more particularly to systems and methods for removing condensation from air conditioning units.

BACKGROUND

FIG. 1 illustrates an air conditioning unit 100 within a wall 102. The wall 102 separates an indoor space 104 from an outdoor space 106. It should be noted that in some cases, the air conditioning unit 100 may be placed in a window of a wall, as opposed to being disposed in a through-hole in the wall that is designed to hold the air conditioning unit 100. In either case, the air conditioning unit includes an indoor side 108 disposed within the indoor space 104 and an outdoor side 110 disposed in the outdoor space 106. The outdoor side 110 includes vents 112 to expel air 114 from the air conditioning unit.

In a cooling mode, a compressor pumps heated refrigerant to an outdoor heat exchanging coil within the outdoor side 110. The outdoor heat exchanging coil will draw the heat from the heated refrigerant and release the heat to the outdoor space 106 as heated air 114 thus cooling the refrigerant. The cooled refrigerant is then pumped through an expansion device that further cools the refrigerant and then to an indoor heat exchanging coil within the indoor side 108. The indoor heat exchanging coil will draw heat from the indoor space 104, thus cooling the indoor space 104, and transfer the heat to the cooled refrigerant. This cycle continues so long as cooling is needed in the indoor area 104. As the indoor coil contains cold/cooled refrigerant, it dehumidifies the indoor air by extracting moisture. This extracted moisture sheds off the indoor coil and pools into excess condensate. Standard practice for air conditioners of similar type is to then use gravity or a condensate pump to remove this condensate to the outdoor side of the system where that condensate can be "thrown" against the hot outdoor coil to evaporate the water or this condensate pools in the unit basepan and typically drips out of the unit. The cycle is reversed in a heating mode.

When operating in the heating mode, if the outdoor coil removes moisture from the outdoor air when the temperature is near or below the freezing point, frost may form on the outdoor heat exchanging coil. If this frost builds up too much, the efficiency of the air condition unit 100 will drop. To avoid this situation, if a predetermined amount of frost is detected, for example by a frost detector, then the air conditioning unit 100 will operate in a defrost mode to melt the frost on the outdoor heat exchanging coil.

In some instances, the melted frost generally drips from the bottom of the air conditioning unit 100. This dripping may irritatingly hit passersby. More concerning, however, is when the melted frost turns into an icicle 116 hanging from the bottom of the air conditioning unit. If the icicle 116 breaks off, it may fall, which is undesirable.

BRIEF DESCRIPTION OF THE DRAWINGS

The detailed description is set forth with reference to the accompanying drawings. In some instances, the use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

Figure 1:
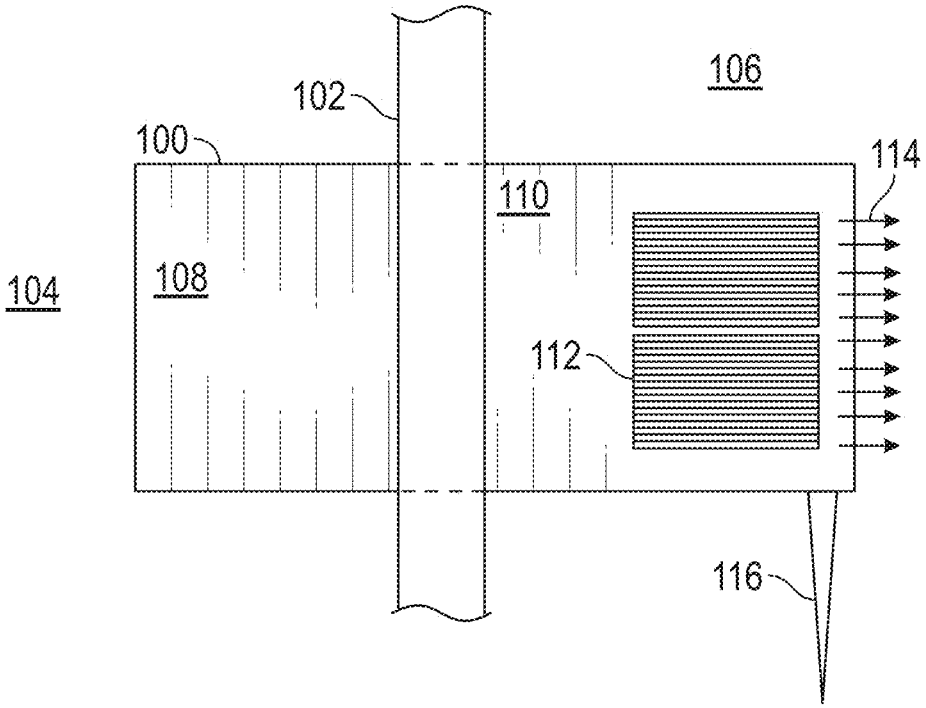
FIG. 1 (Prior Art)
FIG. 1 illustrates an air conditioning unit.

This disclosure relates generally to systems and methods for removing condensate that results from a defrosting operation on an outdoor heat exchanging coil in an air conditioning unit.

In certain embodiments, an air conditioning unit has an indoor side and an outdoor side. The outdoor side includes a drip pan disposed below the outdoor heat exchanging coil. When a defrosting operation is performed on the outdoor heat exchanging coil, the resulting condensate is collected by the drip pan. Further, a condensate pump pumps the collected condensate from the drip pan through a water transport system. The water transport system carries the collected condensate along a path that is near the compressor. Residual heat from the compressor operating is used to heat the condensate while passing through the water transport system near the compressor. This residual heat prevents the condensate from re-freezing within the water transport system.

In some instances, the air condition unit includes a vaporizer that is configured to convert the pumped and heated condensate to vapor. The air conditioning unit additionally also may include a discharge fan that is configured to blow the vapor out through the outdoor side and out to the outside area.

Although certain examples of the disclosed technology are explained in detail herein, it is to be understood that other examples, embodiments, and implementations of the disclosed technology are contemplated. Accordingly, it is not intended that the disclosed technology is limited in its scope to the details of construction and arrangement of components expressly set forth in the following description or illustrated in the drawings. The disclosed technology can be implemented in a variety of examples and can be practiced or carried out in various ways. In particular, the presently disclosed subject matter is described in the context of managing condensate in vapor compression cycle system of an air condition. The present disclosure, however, is not so limited, and can be applicable in other contexts. Accordingly, when the present disclosure is described in the context of managing condensate in vapor compression cycle system of an air condition, it will be understood that other implementations can take the place of those referred to. For example, the systems and methods described herein can be implemented in any vapor compression cycle system, such as a heat pump system of a water heater or the like.

Figure 2:
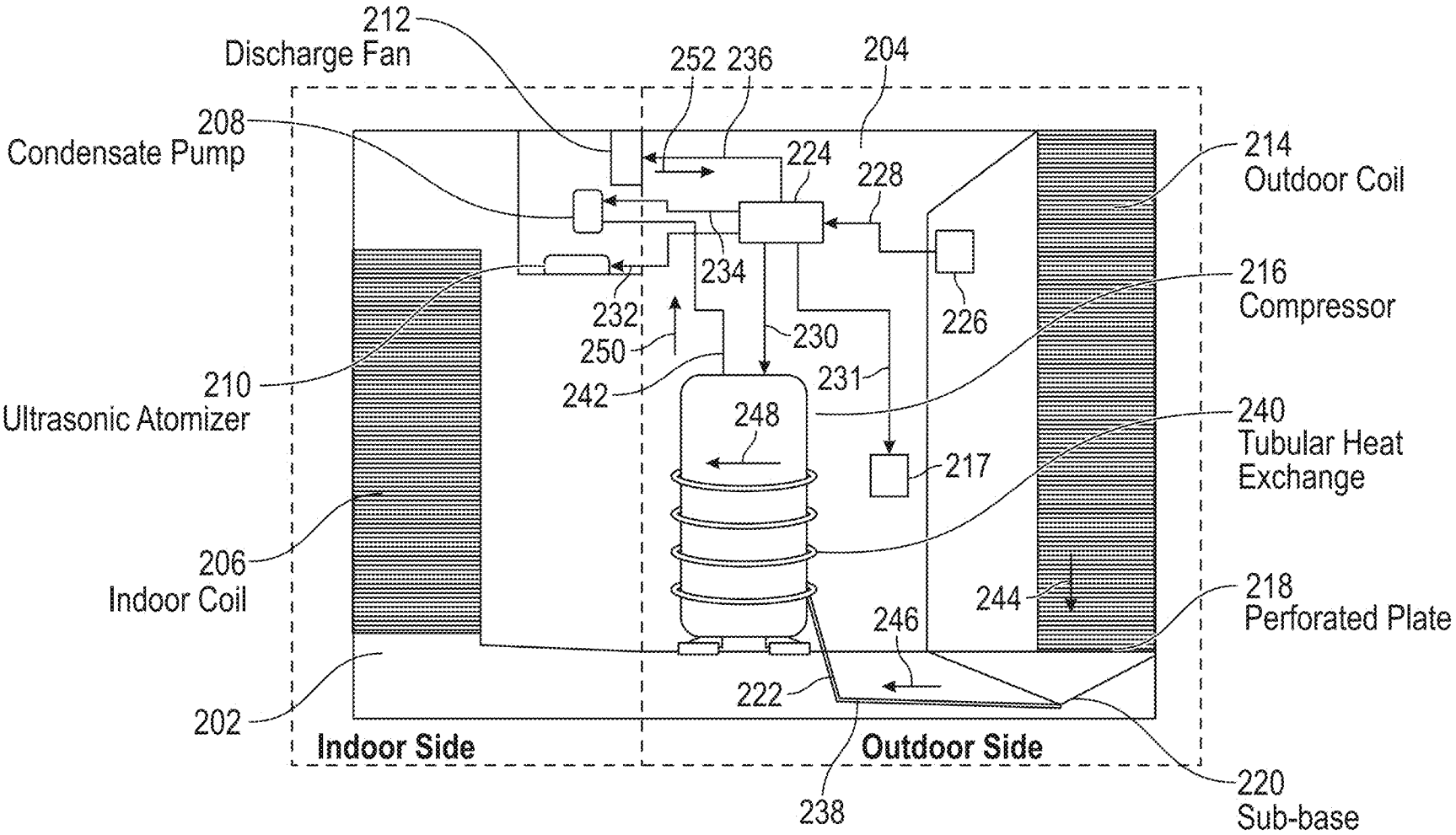
FIG. 2 illustrates an air conditioning unit in accordance with one or more embodiments of the present disclosure.

FIG. 2 illustrates an air conditioning unit 200 in accordance with one or more embodiments of the present disclosure. The air conditioning unit 200 includes an indoor side 202 and an outdoor side 204. The indoor side 202 includes an indoor heat exchanging coil 206, a condensate pump 208, a vaporizer 210 (or an ultrasonic atomizer), and a discharge fan 212. The outdoor side 204 houses an outdoor heat exchanging coil 214, a compressor 216, a reversing valve 217, a perforated plate 218, a sub-base drip pan 220, a water transport system 222, a controller 224, and a frost detector 226. The water transport system 222 includes a pipe section 238, a tubular heat exchanging pipe section 240, and an output section 242.

Additionally included, but not shown for purposes of brevity, are an indoor loop of refrigerant lines between the indoor heat exchanging coil 206, the reversing valve 217, and the compressor 216 and an outdoor loop of refrigerant lines between the outdoor heat exchanging coil 214, the reversing valve 217 and the compressor 216. The reversing valve 217 is a component that is responsible for switching the flow of refrigerant between the compressor 216 and both the indoor coil 206 and the outdoor coil 214. The reversing valve 217 is usually located near the compressor 216 and includes a valve body, a sliding piston, and a solenoid coil.

When the air conditioning unit 200 is in the cooling mode, the reversing valve 217 is in the "cool" position. This means that the refrigerant flows from the compressor 216 to the outdoor coil 214, wherein the outdoor coil 214 releases heat to the outside air. The refrigerant then flows through an expansion valve (not shown) and into the indoor coil 206, wherein the indoor coil 206 absorbs heat from the indoor air. The cooled air is then blown into the room by a fan (not shown).

When the air conditioning unit 200 is in the heating mode, the reversing valve 217 is switched to the "heat" position. This causes the flow of refrigerant to reverse direction. The refrigerant now flows from the compressor 216 to the indoor coil 206, where it releases heat to the indoor air. The refrigerant then flows through an expansion valve and into the outdoor coil 214, wherein the outdoor coil 214 absorbs heat from the outside air. The heated refrigerant is then returned to the compressor 216, where the process starts over again. This will be described with reference to FIG. 10.

Figure 10:
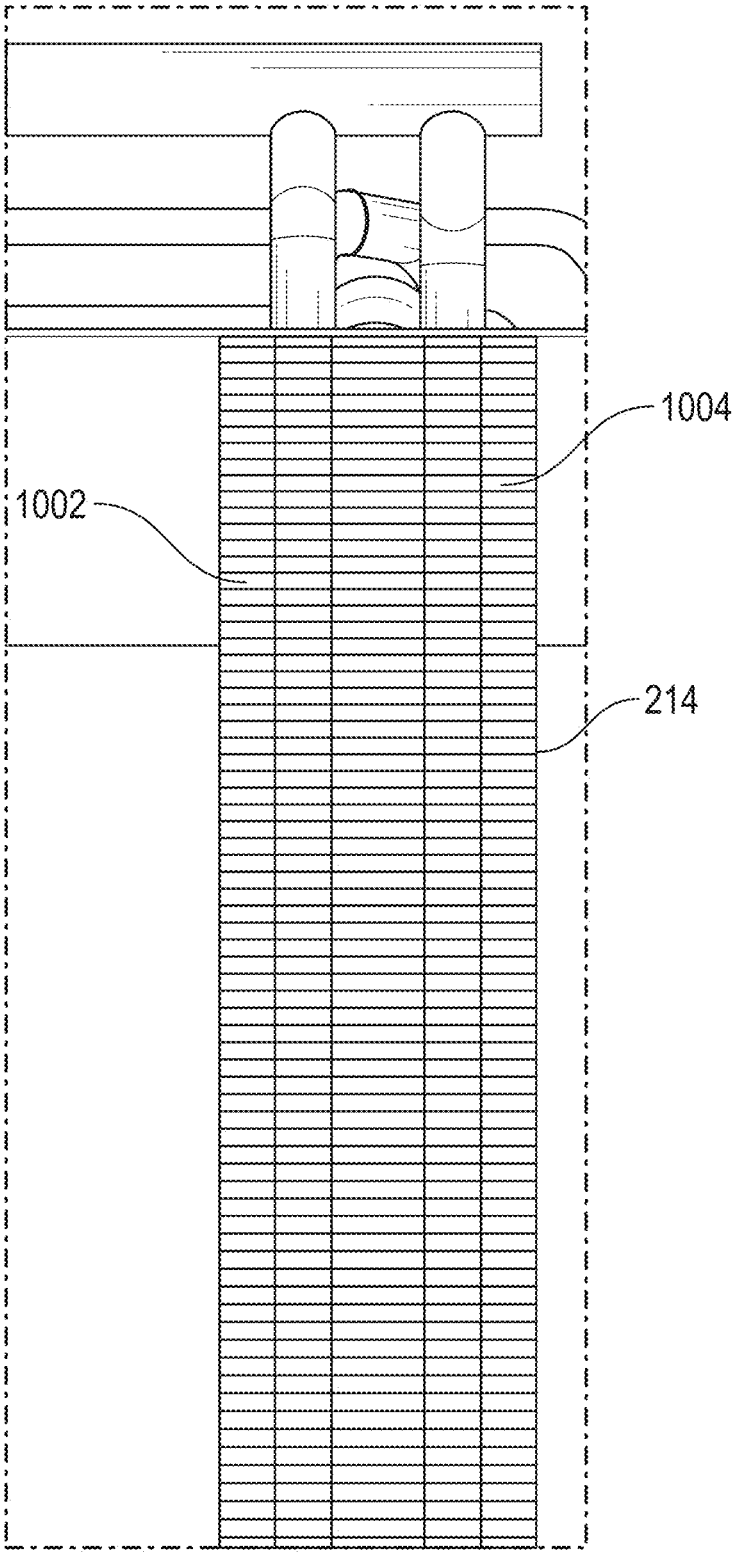
FIG. 10 illustrates a top view of a portion of the portion of the outdoor heat exchange coil of the air conditioning unit of FIG. 2.

FIG. 10 illustrates a top view of a portion the outdoor heat exchange coil 214, which includes a refrigerant tube 1002 and a plurality of heat exchange fins 214 disposed on the refrigerant tube 1002. In operation, a refrigerant is pumped through the refrigerant tube 1002, wherein heat is exchanged between the refrigerant and the air passing through outdoor heat exchange coil 214.

In particular, in a cooling mode, the refrigerant is hot as it enters the refrigerant tube 1002. The heat from the hot refrigerant conducts through the refrigerant tube 1002, conducts through the plurality of heat exchange fins 214 and finally conducts to the air passing through the outdoor heat exchange coil 214 so as to heat the air passing through the outdoor heat exchange coil 214. The cooled refrigerant is then circulated back to the compressor 216 at a lower temperature.

In a heating mode, the refrigerant is cool as it enters the refrigerant tube 1002. The outdoor air passes over the refrigerant tube 1002. Heat from the outdoor air conducts through the plurality of heat exchange fins 214, conducts through the refrigerant tube 1002, and finally conducts to the cool refrigerant so as to heat the refrigerant in the refrigerant tube 1002. The heated refrigerant is then circulated back to the compressor 216 at a higher temperature.

The air conditioning unit 200 also may include communication lines 228, 230, 231, 232, 234, and 236. The controller 224 is arranged to communicate with the frost detector 226 via the communication line 228, with the compressor 216 via the communication line 230, with the vaporizer 210 via the communication line 232, with the reversing valve 217 via the communication line 231, with the condensate pump 208 via the communication line 234, and with the discharge fan 212 via the communication line 236.

The frost detector 226 is arranged to detect frost on the outdoor heat exchanging coil 214. The perforated plate 218 is disposed below the outdoor heat exchanging coil 214 to support the outdoor coil above the sub-base drip pan 220. The sub-base drip pan 220 is disposed below the perforated plate 218 to catch any condensate from the outdoor heat exchanging coil 214.

In a cooling mode, the compressor 216 is configured to pump heated refrigerant to the outdoor heat exchanging coil 214. The outdoor heat exchanging coil 214 is configured to draw the heat from the heated refrigerant and release the heat to the outdoors, thus cooling the refrigerant again. The cooled refrigerant is then pumped through an expansion device to the indoor heat exchanging coil 206. The indoor heat exchanging coil 206 is configured to draw heat from the indoor space, thus cooling the indoor space, and transferring the heat to the cooled refrigerant. This cycle continues so long as cooling is needed in the indoor area.

When operating in the heating mode, if the outdoor coil removes moisture from the outdoor air when the temperature is near or below the freezing point, frost may form on the outdoor heat exchanging coil 214. If this frost builds up too much, the efficiency of the air condition unit 200 will drop. To avoid this situation, if a predetermined amount of frost is detected, for example by the frost detector 226, then the air conditioning unit 200 will operate in a defrost mode to melt the frost on the outdoor heat exchanging coil 214.

In certain embodiments, the air conditioning unit 200 is able to remove the water resulting from the defrosting of the outdoor heat exchanging coil 214 by pumping the water to the vaporizer 210, which turns the water to vapor. The discharge fan 212 then blows the vapor to the outdoors. This will be described in greater detail with reference to FIG. 3.

Figure 3:
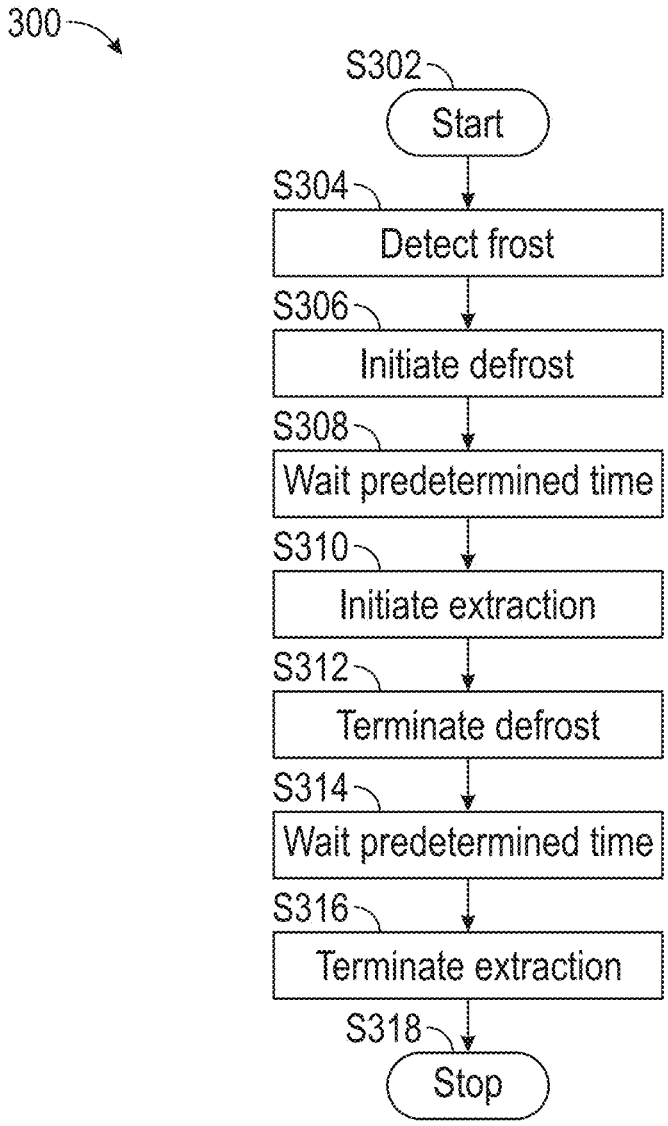
FIG. 3 illustrates a method of operating the air conditioning unit of FIG. 2 in accordance with one or more embodiments of the present disclosure.

FIG. 3 illustrates a method 300 of operating the air conditioning unit 200. The method 300 starts (S302) in normal heating operation and is continuously monitoring for frost until it is detected (S304). For example, as shown in FIG. 2, the frost detector 226 detects frost on the outdoor heat exchanging coil 214 and sends a frost detection signal to the controller 224 via the communication line 228. This will be described in greater detail with reference to FIG. 4A.

Figure 4A:
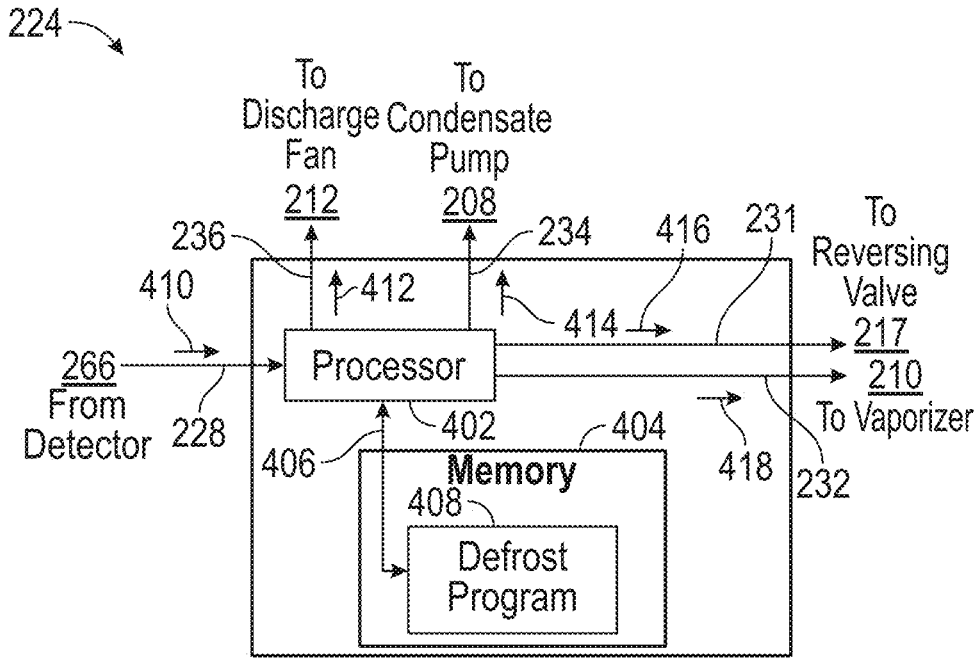
FIG. 4A illustrates a controller of the air conditioning unit of FIG. 2 at one stage of operation in accordance with one or more embodiments of the present disclosure.

FIG. 4A illustrates the controller 224 of the air conditioning unit 200 at one stage of operation. The controller 224 includes a processor 402 and a memory 404. The processor 402 is arranged to communicate with the memory 404 via a communication line 406.

In certain embodiments, the processor 402 and the memory 404 are illustrated as individual devices. However, in some embodiments, the processor 402 and the memory 404 may be combined as a unitary device. Any number of processors and memory may be used herein. The processor 402 may be implemented as a hardware processor such as a microprocessor, a multi-core processor, a single core processor, a field programmable gate array (FPGA), a microcontroller, an application specific integrated circuit (ASIC), a digital signal processor (DSP), or other similar processing device capable of executing any type of instructions, algorithms, or software for controlling the operation of the air conditioning unit 200 in accordance with one or more embodiments described in the present disclosure. The controller 224 may include any suitable computing devices.

The memory 404 has data and instructions, including the defrost program 408 stored therein. In some embodiments, the defrost program 408 includes instructions, that when executed by the processor 402, cause the controller 224 to cause the compressor 216 to pump a refrigerant in a defrosting mode (cooling cycle) which triggers the condensate pump 208 to pump condensate. The outdoor heat exchanging coil 214 operates in a defrosting mode to melt ice formed on the outdoor heat exchanging coil 214 into condensate.

In some embodiments, the defrost program 408 includes instructions, that when executed by the processor 402, cause the controller 224 to cause the vaporizer 210 to convert the pumped condensate in the reservoir to vapor. In other embodiments, the defrost program 408 includes instructions, that when executed by the processor 402, cause the controller 224 to cause the discharge fan 212 to blow out the vapor created by the vaporizer 210. In addition, in some embodiments, the defrost program 408 includes instructions, that when executed by the processor 402, cause the controller 224 to instruct the reversing valve 217 to operate in a heating mode, instruct the condensate pump 208 to operate, and instruct the vaporizer 210 to operate. Further, in other embodiments, the defrost program 408 includes instructions, that when executed by the processor 402, cause the controller 224 to instruct the condensate pump 208 to operate for a first predetermined period of time and after a second predetermined period of time after instructing the compressor 216 to pump the refrigerant in the defrosting mode.

At this stage of the method 300, the frost detector 226 sends a frost detection signal 410 to the processor 402 via the communication line 228. In certain embodiments, the frost detector 226 includes a temperature sensor that is configured to output the frost detection signal 410 as a continuous signal based on the continuously detected temperature of the outdoor heat exchanging coil 214. In these embodiments, the memory 404 may have stored therein a predetermined threshold temperature associated with a threshold amount of frost that may be formed on the outdoor heat exchanging coil 214. In these embodiments, the processor 402 may continuously compare the received frost detection signal 410 with the predetermined threshold temperature stored in the memory 404. In other instances, the processor 402 may periodically compare the received frost detection signal 410 with the predetermined threshold temperature stored in the memory 404. In some instances, the periodicity of the comparing may be on the order of minutes, e.g., 5 minutes. Any suitable time frame may be used herein.

In certain embodiments, the frost detector 226 comprises a temperature sensor that is configured to output the frost detection signal 410 only when the detected temperature drops below a predetermined threshold temperature. In some instances, the predetermined threshold temperature is associated with a threshold amount of frost that may be formed on the outdoor heat exchanging coil 214.

Figure 5:
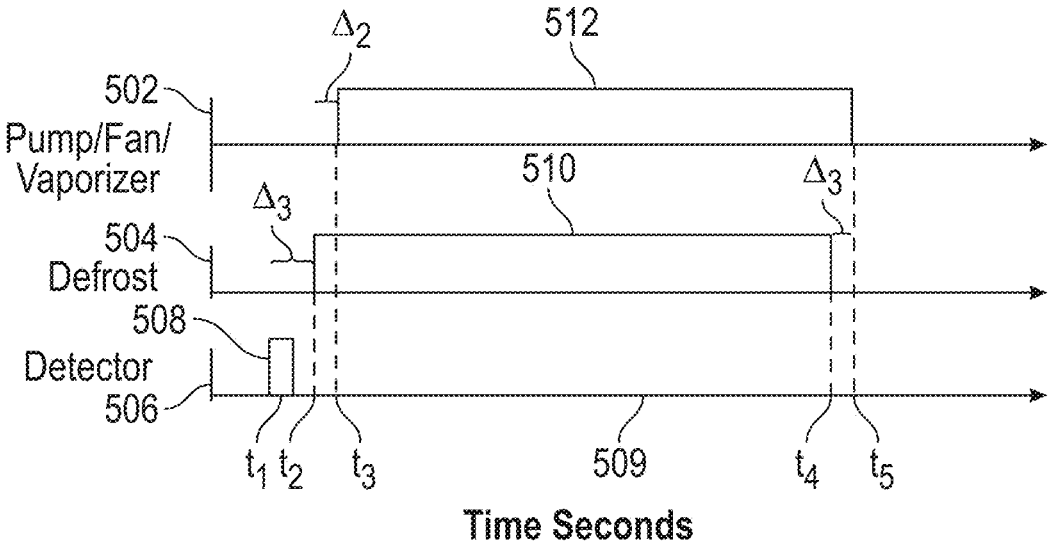
FIG. 5 illustrates timing diagrams of processes of the air conditioning unit of FIG. 2 in accordance with one or more embodiments of the present disclosure.

FIG. 5 illustrates timing diagrams of processes of the air conditioning unit 200. A timing diagram 502 is drawn to the operation of the condensate pump 208, the vaporizer 210, and the discharge fan 212. A timing diagram 504 corresponds to the performance of a defrost mode of operation of the air conditioning unit 200. A timing diagram 506 corresponds to the operating of the frost detector 226. The timing diagrams 502, 504, and 506 have a common x-axis 509, although this is shown as three separate axes to separate the respective timing diagrams. In this example, the frost detector 226 outputs the frost detection signal 410 at time $t_1$, as shown by function 508 of timing diagram 506, when the detected temperature drops below a predetermined threshold temperature. A sensor is used to prevent overflow or trigger condensate removal.

Returning to FIG. 3, after frost is detected (S304), a defrost process is initiated (S306). For example, as shown in FIG. 2, the controller 224 instructs the reversing valve 217 to reverse the refrigerant so as to operate in a defrost mode, wherein the reversing valve shuttles the heated refrigerant as a compressed gas to the outdoor heat exchanging coil 214. The heated refrigerant will pass through the outdoor heat exchanging coil 214, thus heating the outdoor heat exchanging coil 214 and melting any frost that has built up on the outdoor heat exchanging coil 214.

As shown in FIG. 4A, processor 402 executes instructions in the defrost program 408 to generate a defrost instruction 416, which is transmitted to the reversing valve 217 via the communication line 231. As shown in the timing diagram 504 of FIG. 5, the defrost process starts at time $t_2$, which is after an algorithmic calculation of outdoor temperature, indoor temperature, and time below freezing $\Delta_1$ after the frost detector 226 outputs the frost detection signal 508 at time $t_1$. This algorithmic time period $\Delta_1$ represents the time needed from the controller 224 to instruct the reversing valve 217 to switch operation to the heating mode.

In some embodiments, processor 402 executes instructions in the defrost program 408 to start a timer when the outdoor heat exchange coil 214 is detected to be below a certain temperature. Once the timer reaches a predetermined amount of time below that temperature, e.g., 1 hour, the defrost process will be initiated. The defrost process continue until the detected temperature of the outdoor heat exchange coil 214 rises above a static or calculated value that is above freezing to ensure that the outdoor heat exchange coil 214 has been cleared of any frost or ice. As such, in some embodiments, the time period $\Delta_1$ may be on the order of an hour or hour and a half.

Returning to FIG. 3, after the defrost process is initiated (S306), a period of time passes (S308). As mentioned above, in certain embodiments, the condensate may be collected in sub-base 220 through perforated plate 218, pumped away from the outdoor heat exchanging coil 214, vaporized, and then the vapor blown out to the outdoors with a fan. However, as shown in FIG. 2, operating the condensate pump 208, the vaporizer 210, and the discharge fan 212 constantly would waste energy, in the event that there is no condensate to remove. In some instances, to minimize energy loss, in accordance with one or more embodiments of the present disclosure, the condensate pump 208, the vaporizer 210, and the discharge fan 212 are not turned on until there is condensate to remove. More specifically, as shown in FIG. 5, in the timing diagram 504, the defrost process starts at time $t_2$. However, the condensate pump 208, the vaporizer 210, and the discharge fan 212 are not turned on until time $t_3$, a period of time $\Delta_2$ after the defrost process starts, or water is sensed. It may take some time for some frost to melt to create condensate to remove. This delay time period, $\Delta_2$, accounts for this.

Returning to FIG. 3, after the period of time passes (S308), an extraction process is initiated (S310). For example, as shown in FIG. 2, the controller 224 instructs the condensate pump 208 to pump the condensate from the sub-base drip pan 220 to the vaporizer 210 and instructs the discharge fan 212 to blow the resulting vapor to the outdoors.

As shown in FIG. 4A, the processor 402 executes instructions in the defrost program 408 to transmit a discharge fan instruction 412 to the discharge fan 212 via the communication channel 236, transmit a condensate pump instruction 414 to the condensate pump 208 via the communication channel 234, and to transmit a vaporizer instruction 418 to the vaporizer 210 via the communication channel 232. Upon receiving the discharge fan instruction 412, the discharge fan 212 turns on. Upon receiving the condensate pump instruction 414, the condensate pump 208 turns on. Upon receiving the vaporizer instruction 418, the vaporizer 210 turns on.

Returning to FIG. 2, when the outdoor coil 214 starts defrosting, condensate falls, due to gravity, to and passes through the perforated plate 218, as shown by the arrow 244. The sub-base drip pan 220 catches the condensate that falls through the perforated plate 218. This will be described in greater detail with reference to FIGS. 6A-B.

Figure 6A:
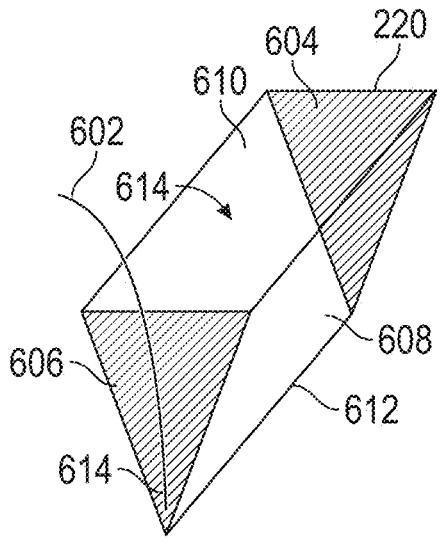
FIG. 6A illustrates an oblique view of a drip pan of the air conditioning unit of FIG. 2 in accordance with one or more embodiments of the present disclosure.

FIG. 6A illustrates an oblique view of the sub-base drip pan 220 of the air conditioning unit of FIG. 2, with a siphoning pipe 602 disposed therein. In some instances, the sub-base drip pan 220 has a triangular front face 606, a triangular back face 604, a side 608 and a side 610. The triangular front face 606 is connected to both the side 608 and the side 610. The triangular back face 604 is also connected to both the side 608 and the side 610, thus forming a condensate holding area 614. The side 608 and the side 610 connect to form a pointed bottom 612 of the condensate holding area 614 where the condensate will accumulate. The sub-base drip pan can be of any shape with emphasis on providing a low spot to help direct the condensate to a primary drain location.

Figure 6B:
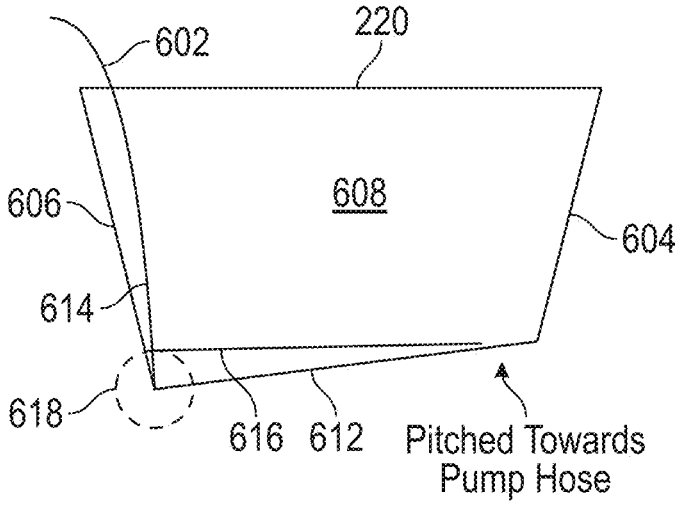
FIG. 6B illustrates a side view of the drip pan of FIG. 6A in accordance with one or more embodiments of the present disclosure.

FIG. 6B illustrates a side view of the sub-base drip pan 214. The siphoning pipe 602 is positioned such that the end 614 is disposed at a bottom corner area 618 of the sub-base drip pan 214. The pointed bottom 612 of the sub-base drip pan 214 is angled to force the accumulated condensate 616 to flow toward the bottom corner area 618. This ensures that the siphoning pipe 602 is able to siphon all the accumulated condensate 616. The siphoning pipe 602 corresponds to an example of the pipe section 238 of the water transport system 222 of FIG. 2. Siphoning pipe 602 may be any material that is resistant to corrosion, non-limiting examples of which include plastic and copper piping. The frost detector 226 is used to trigger condensate pumping.

Returning to FIG. 2, condensate pump 208 is configured to pump the condensate from the sub-base drip pan 220 via the water transport system 222. In particular, the condensate is siphoned from the sub-base drip pan 220 through the pipe section 238 to the tubular heat exchanging pipe section 240 as shown by the arrow 246. The condensate passes through the tubular heat exchanging pipe section 240, as shown by the arrow 248, wherein the condensate is heated from residual heat produced by the compressor 216. This residual heat prevents the condensate from refreezing in the outdoor side 204 of the air condition unit 200. The heated condensate is then pumped to the vaporizer 210 as shown by the arrow 250.

At this point the vaporizer 210 converts the heated pumped condensate to vapor. The discharge fan 212 then blows the vapor out through the outdoor side as shown by the arrow 252. The vapor exits to the outside of the air conditioning unit 200. Because the condensate is ejected from the air conditioning unit 200 as a vapor, it will not drip onto passersby or form into icicles under the air conditioning unit 200. By using the residual heat from the compressor 216 to heat the condensate, and therefore prevent it from refreezing while in the outdoor side 204, the system is energy efficient because there is no need for an additional heating element.

As depicted in FIG. 2, the discharge fan 212, the condensate pump 208, and the vaporizer 210 are disposed on the indoor side 202 of the air conditioning unit 200. It should be noted that at least one of these elements may be positioned in the outdoor side 204 of the air conditioning unit. However, positioning these elements on the indoor side 202 aids in maintenance of the discharge fan 212, the condensate pump 208, and the vaporizer 210. In particular, if disposed in the outdoor side 204, if any of the discharge fan 212, the condensate pump 208, or the vaporizer 210 need maintenance, then the entire air conditioning unit 200 may need to be removed to access them.

Returning to FIG. 3, after the extraction process is initiated (S310), the defrost process is terminated (S312). For example, as shown in FIG. 2, the controller 224 instructs the reversing valve 217 to reverse the flow of the refrigerant so as to return to the cooling mode via the communication line 231. This will be described in greater detail with reference to FIG. 4B.

Figure 4B:
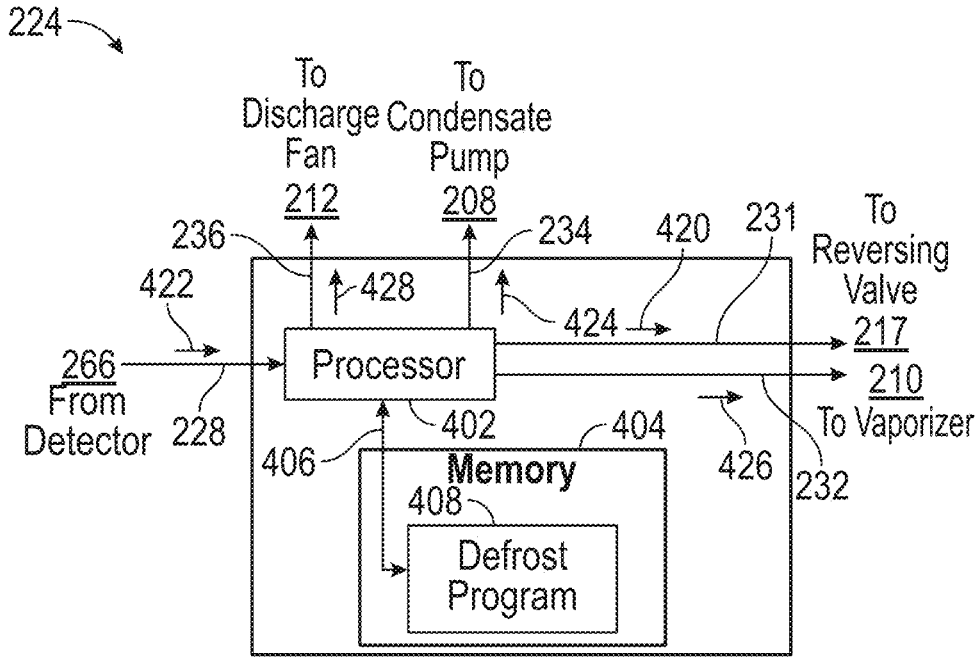
FIG. 4B illustrates the controller of the air conditioning unit of FIG. 2 at a subsequent state of operation in accordance with one or more embodiments of the present disclosure.

FIG. 4B illustrates the controller of the air conditioning unit of FIG. 2 at a subsequent state of operation. The processor 402 executes instructions in the defrost program 408 and transmits a cooling instruction 420 to the reversing valve 217 via the communication line 231. In certain embodiments, the defrost process is performed for a predetermined period of time algorithmic to the controller.

In some embodiments, the defrost process is dependent on the frost detector 226, located on the outdoor heat exchanging coil 214, detecting a temperature above a predetermined temperature associated with frost. In some embodiments, the time period is usually on the order of 2-3 minutes, wherein a maximum defrost period might be on the order of 10-15 minutes; this time period may vary as needed to avoid sacrificial defrosts.

The frost detector 226 may send a detection signal 422 to the processor 402 via the communication line 228. The detection signal 422 indicates that the detected temperature of the outdoor heat exchanging coil 214 has risen above a threshold temperature, which indicates that no more frost is on the outdoor heat exchanging coil 214. In these embodiments, the processor 402 executes instructions in the defrost program 408 to transmit the cooling instruction 420 based on the receipt of the detection signal 422 from the frost detector 226. As shown in FIG. 5, in the timing diagram 504, it can be seen that the defrost process is performed at function 510 between times $t_2$ and $t_4$.

Returning to FIG. 3, after the defrost process is terminated (S312), another period of time passes (S314). For example, as shown in FIG. 4B, the processor 402 will execute instructions in the defrost program 408 to cause the processor 402 to wait a predetermined period of time after the defrost process is terminated before terminating the extraction process.

Returning to FIG. 3, after the period of time passes (S314), the extraction process is terminated (S316). For example, as shown in FIG. 2, the controller 224 instructs the condensate pump 208 to stop pumping via the communication line 234, instructs the vaporizer 210 to stop vaporizing via the communication line 232, and instructs the discharge fan 212 to stop blowing via the communication line 236. As shown in FIG. 4B, the processor 402 transmits a stop pumping signal 424 to the condensate pump 208 via the communication line 234 to cause the condensate pump 208 to stop pumping, transmits a stop vaporizing signal 426 to the vaporizer 210 via the communication line 232 to cause the vaporizer 210 to stop vaporizing, and transmits a stop blowing signal 428 to the discharge fan 212 via the communication line 236 to cause the discharge fan 210 to stop blowing.

As shown in FIG. 5, in the timing diagram 502, the function 512 shows the condensate pump 208, the vaporizer 210, and the discharge fan 212 operating from a time $t_3$ to a time $t_5$. In some embodiments, the delay from time $t_3$ to time $t_5$ may be on the order of about 30 seconds to two (2) minutes. It should be noted that the condensate pump 208, the vaporizer 210, and the discharge fan 212 stop operating at time $\Delta_3$ after the defrost process terminates. This ensures that any condensate that falls at the end of the defrost process will make its way through the water transport system 222, be vaporized by the vaporizer 210, and be blown out by the discharge fan 212.

In this example, the condensate pump 208, the vaporizer 210, and the discharge fan 212 are all indicated as stopping at the same time, $t_5$. However, in one or more embodiments, the condensate pump 208, the vaporizer 210, and the discharge fan 212 may stop at different times. In particular, in some instances, the condensate pump 208 may stop first, followed by the vaporizer 210, and finally followed by the discharge fan 212.

Returning to FIG. 3, after the extraction process is terminated (S316), method 300 ends (S318). Accordingly, as a result of method 300, when the outdoor heating exchange coil is defrosted, the condensate is collected, pumped about the compressor 216 to heat the condensate with the residual heat of the compressor 216, pumped to the indoor side 202 of the air conditioning unit, and then vaporized by the vaporizer 210. The vapor is then blown outside of the air conditioning unit by the discharge fan 212. Therefore, the condensate resulting from the defrost process does not drip out from the bottom of the air conditioning unit 200 and does not form icicles on the outside bottom of the air conditioning unit 200.

The air conditioning unit of the present disclosure may have additional aspects or modifications. These will be described in greater detail with reference to FIGS. 7-12.

Figure 7:
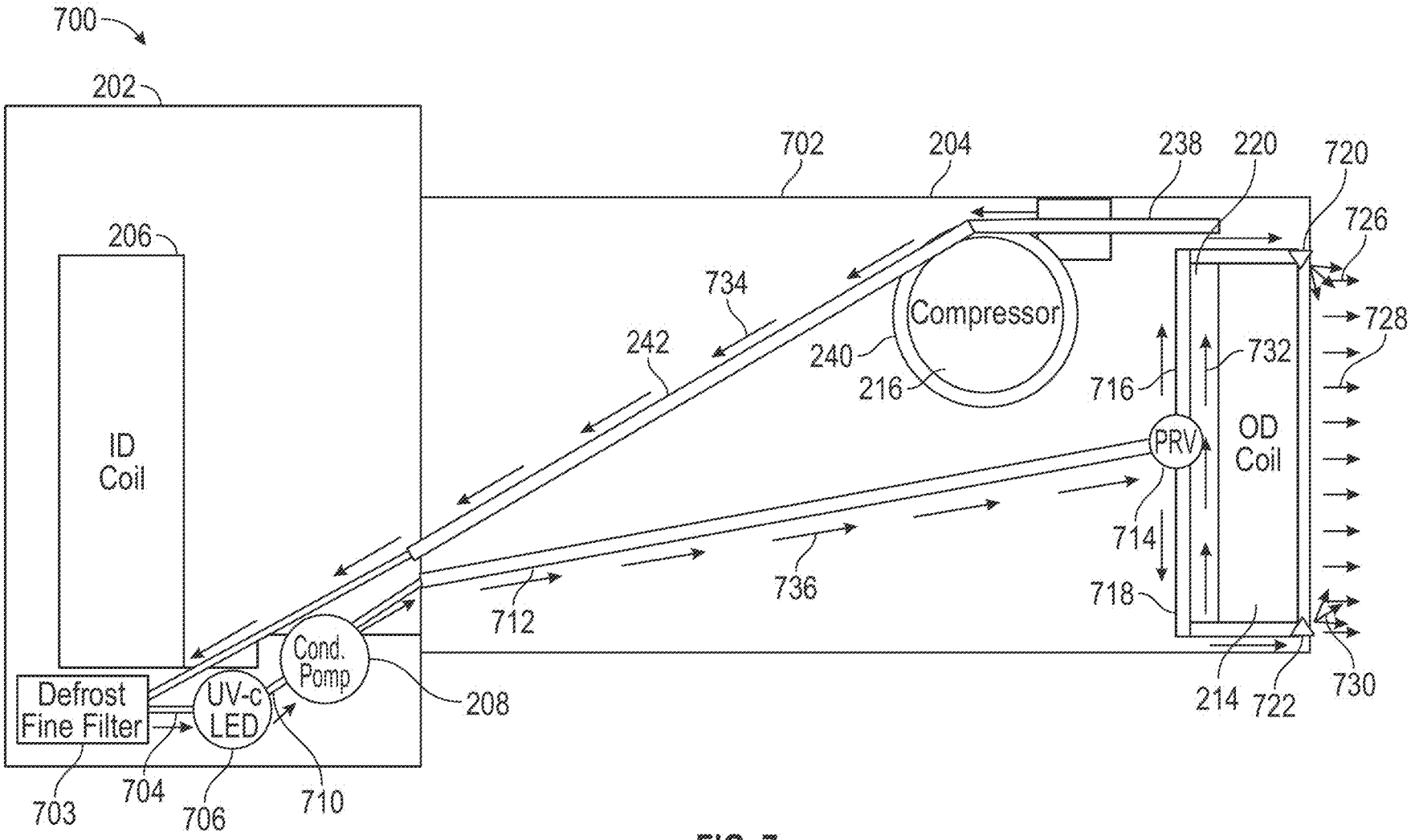
FIG. 7 illustrates another air conditioning unit in accordance with one or more embodiments of the present disclosure.

FIG. 7 illustrates another air conditioning unit 700 in accordance with one or more embodiments of the present disclosure. Elements in the air conditioning unit 700 that are similar to that of the air conditioning unit 200 discussed above with reference to FIG. 2 are similarly numbered. The air conditioning unit 700 additionally includes a bridge section 702 disposed between the outdoor side 204 and the indoor side 202. The bridge section 702 more accurately reflects the portion of the air conditioning unit 700 that lies within the wall. In this manner, the indoor side 202 is disposed in the interior area of a room to be conditioned, and the outdoor side 204 is disposed outside of the interior area, which is typically outside of a building.

The air conditioning unit 700 additionally includes a filter 703, a pipe 704, an ultra-violet (UV) light emitting diode (LED) 706, a pipe 710, a pipe 712, a pressure relief valve 714, a pipe 716, a pipe 718, a vaporizer 720, and a vaporizer 722. The filter 703 is arranged to receive condensate from the output section 242, filter out particulates from the condensate, and pass the remaining filtered condensate to pipe 704. The pipe 704 is arranged to pass the filtered condensate from the filter 703 to the UV LED 706. The UV LED 706 irradiates the filtered condensate to kill any bacteria/viruses within the filtered condensate. The pipe 710 is arranged to pass the filtered and UV irradiated condensate to the condensate pump 208. The condensate pump 208 then further pumps the filtered and UV irradiated condensate through the pipe 712 to the pressure relieve valve 714. As a safety mechanism, in such cases wherein the pressure gets too high, the pressure relief valve 714 is configured to open at a preset pressure and discharge some of the filtered and UV irradiated condensate until pressure drops to a predetermined acceptable level. In some instances, the pressure relief valve 714 would only open if there is a clog in the water transport system.

The pipe 712 is arranged to split flow of the filtered and UV irradiated condensate to the pipe 716 and the pipe 718 at the pressure relief valve 714. The pipe 716 feeds a portion of the filtered and UV irradiated condensate to the vaporizer 720. The pipe 718 feeds the other portion of the filtered and UV irradiated condensate to the vaporizer 722. The vaporizer 720 is configured to output vapor 726 of its portion of the filtered and UV irradiated condensate to an outer edge of an outflow of air 728 from the outdoor heat exchanging coil 214. Similarly, the vaporizer 722 is configured to output vapor 730 of its portion of the filtered and UV irradiated condensate to an outer edge of the outflow of air 728 from the outdoor heat exchanging coil 214.

In operation, when the outdoor heat exchanging coil 214 operates in a defrost mode to generate condensate, the condensate is caught in the sub-base drip pan 220 and flows in a direction indicated by arrows the 732 toward the pipe section 238. The condensate pump 208 pumps the condensate through the pipe section 238 and through the tubular heat exchanging pipe section 240, which heats the condensate from residual heat from the compressor 216. After flowing through the tubular heat exchanging pipe section 240 and being heated, the condensate passes through the output section 242, as indicated by arrows 734. The filter 703 filters out particulates, and the UV LED 706 additionally kills any organism within the heated pumped condensate. The heated, filtered and UV-treated condensate is the pumped to the vaporizer 720 and the vaporizer 722.

In some instances, the system may include two or more pumps for pumping condensate and/or water from the outside portion of the system, to the indoor portion of the system, and then back to the outside portion of the system. For example, one pump may be configured to pump condensate from the outside portion of the system (e.g., from the outside drip pan) to a drain pan on the inside portion of the system. In some instances, the water may be stored (e.g., temporarily or longer) in the drain pain on the indoor side portion of the system. Next, a second pump may be configured to pump water from the indoor drain pan back to the outside portion of the system where the water can be disposed of via, e.g., the vaporizer or the like. In other instances, the water may be instantly pumped back to the outside portion of the system.

In certain embodiments, the tubular heat exchanging pipe section 240 may be arranged about the compressor 216 in many different manners in order to heat the condensate. Some examples will now be described in greater detail with reference to FIGS. 8-11.

Figure 8:
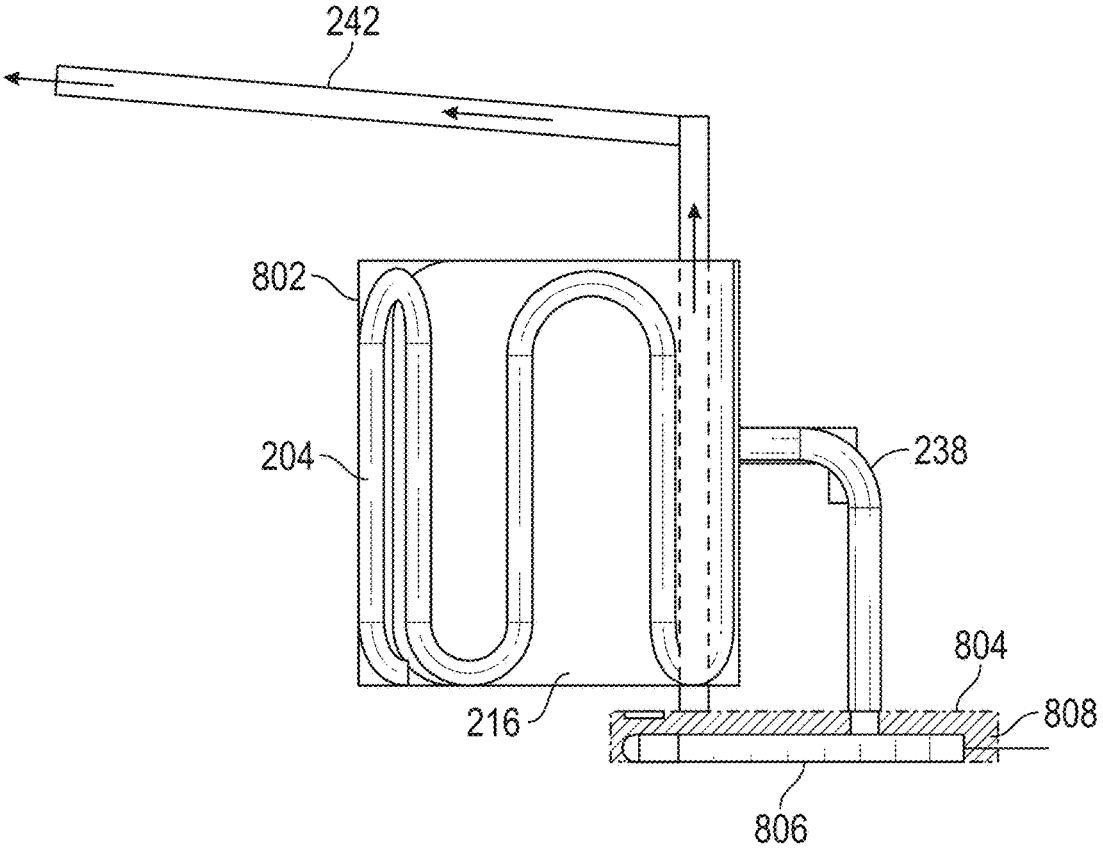
FIG. 8 illustrates a side view of the compressor and a portion of the water transport system of the air conditioning unit of FIG. 7 in accordance with one or more embodiments of the present disclosure.
Figure 9:
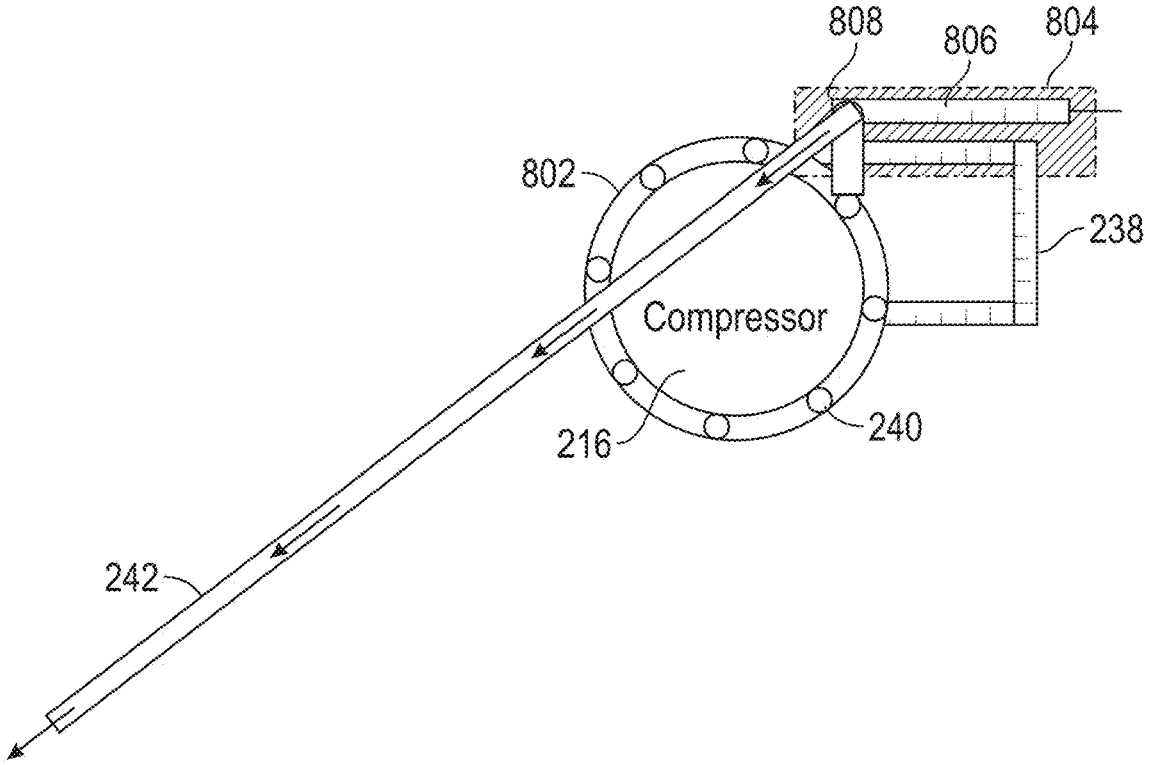
FIG. 9 illustrates a top view of the compressor and a portion of the water transport system of FIG. 8 in accordance with one or more embodiments of the present disclosure.

FIG. 8 illustrates a side view of the compressor 216 and a portion of the water transport system 222 of the air conditioning unit 700. FIG. 9 illustrates a top view of the compressor 216 and a portion of the water transport system 242 of FIG. 8. As shown in the figures, the tubular heat exchanging pipe section 240 forms a longitudinal serpentine shape about the circumference of the compressor 216. Further, in one or more embodiments, the tubular heat exchanging pipe section 240 and the compressor 216 may be surrounded by an insulating layer 802. The insulating layer 802 prevents the residual heat from the compressor 216 from escaping into the ambient air thus forcing the heat into the tubular heat exchanging pipe section 240. This increases the heat transfer into the condensate, thus heating it more and/or more rapidly. Insulating layer 802 may be fabricated from materials including vinyl fabric, cotton, flexible rubber, and ethylene propylene diene monomer (EPDM) foam insulation.

Further, in one more embodiments, the drip-pan may include a flat section 804 configured to receive a length of pipe 806 as part of the pipe section 238. In these embodiments, the length of pipe 806 may be surrounding by a mesh bag 808 that filters particulates from condensate. Further, the length of pipe 806 may have a plurality of holes along its length.

Figure 11:
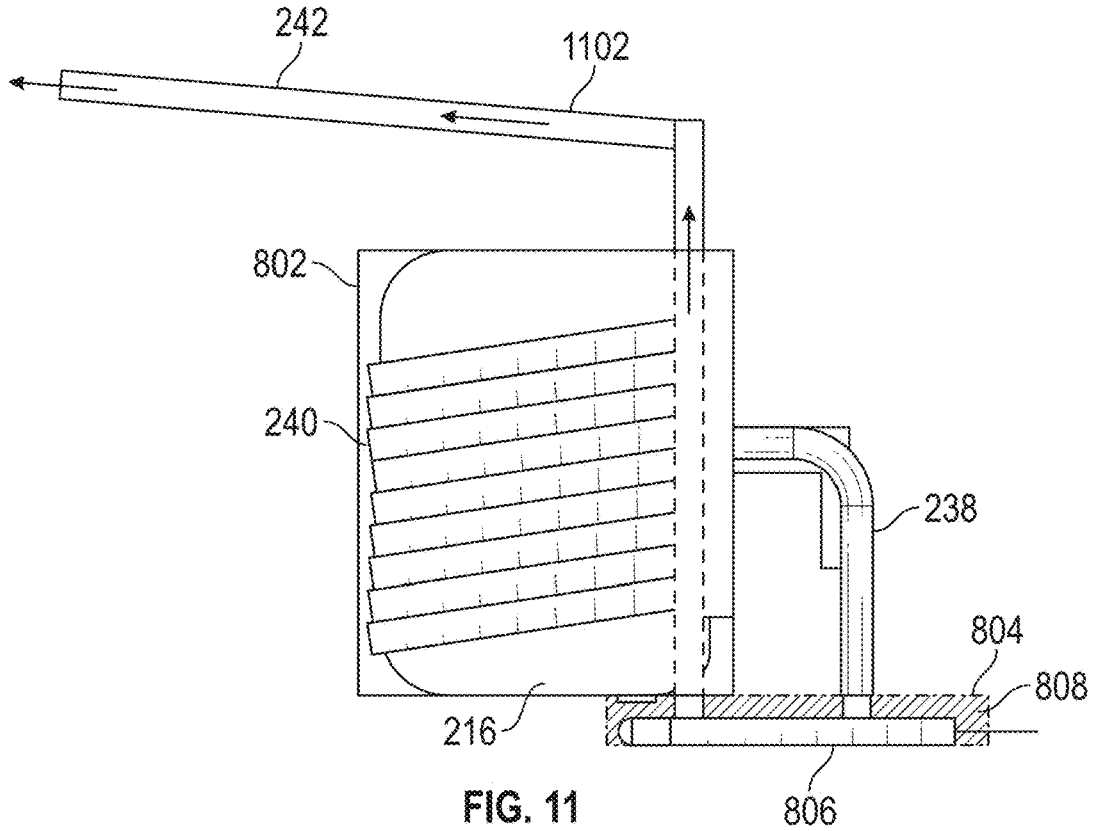
FIG. 11 illustrates a side view of the compressor and a portion of another water transport system that may be optionally used the air conditioning unit of FIG. 7 in accordance with one or more embodiments of the present disclosure.

FIG. 11 illustrates a side view of the compressor 216 and a portion of another water transport system 1102 that may be optionally used with the air conditioning unit 700 of FIG. 7. In this example, the water transport system 1102 includes the pipe section 238, the tubular heat exchanging pipe section 240, and the output section 242. However, as shown in FIG. 11, the tubular heat exchanging pipe section 240 coils about the circumference of the compressor 216. Further, in one or more embodiments, the tubular heat exchanging pipe section 240 and the compressor 216 may be surrounded by the insulating layer 802. The insulating layer 802 prevents the residual heat from the compressor 216 from escaping into the ambient air thus forcing the heat into the tubular heat exchanging pipe section 240. This increases the heat transfer into the condensate, thus heating it more and/or more rapidly.

Figure 12:
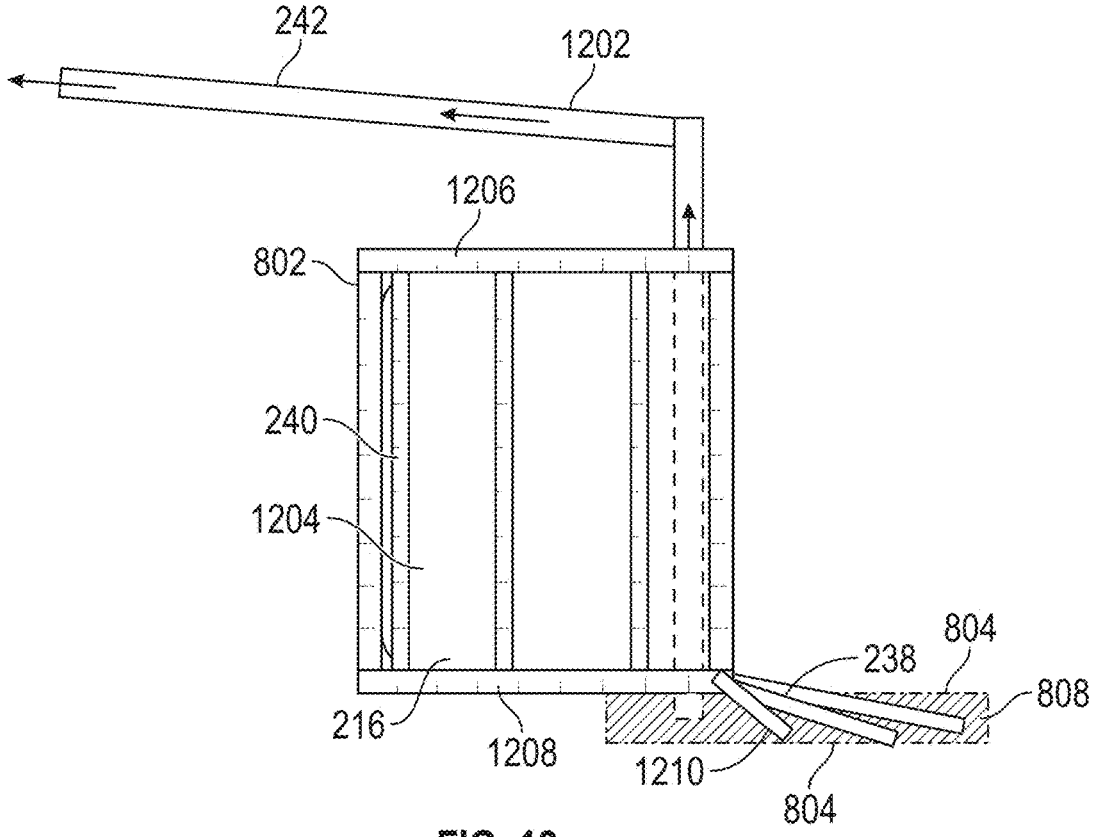
FIG. 12 illustrates a side view of the compressor and a portion of still another water transport system that may be optionally used the air conditioning unit of FIG. 7 in accordance with one or more embodiments of the present disclosure.

FIG. 12 illustrates a side view of the compressor 216 and a portion of still another water transport system 1202 that may be optionally used with the air conditioning unit 700 of FIG. 7. In this example, the water transport system 1202 includes the pipe section 238, the tubular heat exchanging pipe section 240, and the output section 242. However, as shown in FIG. 12, the tubular heat exchanging pipe section 240 is in the form of a plurality longitudinal pipes, a sample of which is indicated as longitudinal pipe 1204, about the circumference of the compressor 216. Further, the plurality of longitudinal pipes are connected to one another by a top circumferential pipe 1206 and a bottom circumferential pipe 1208. Further, in one or more embodiments, the tubular heat exchanging pipe section 240 and the compressor 216 may be surrounded by the insulating layer 802. The insulating layer 802 prevents the residual heat from the compressor 216 from escaping into the ambient air thus forcing the heat into the tubular heat exchanging pipe section 240. This increases the heat transfer into the condensate, thus heating it more and/or more rapidly. Further, in some instances, the drip-pan may include the flat section 804 configured to receive a plurality of open ended pipes, a sample of which is indicated as open ended pipe 1210. In these embodiments, the open ends of the plurality of open ended pipes may be surrounding by the mesh bag 808 that filters particulates from condensate. Each of the plurality of open ended pipes may siphon condensate from different areas of the flat section 804, respectively.

Figure 13:
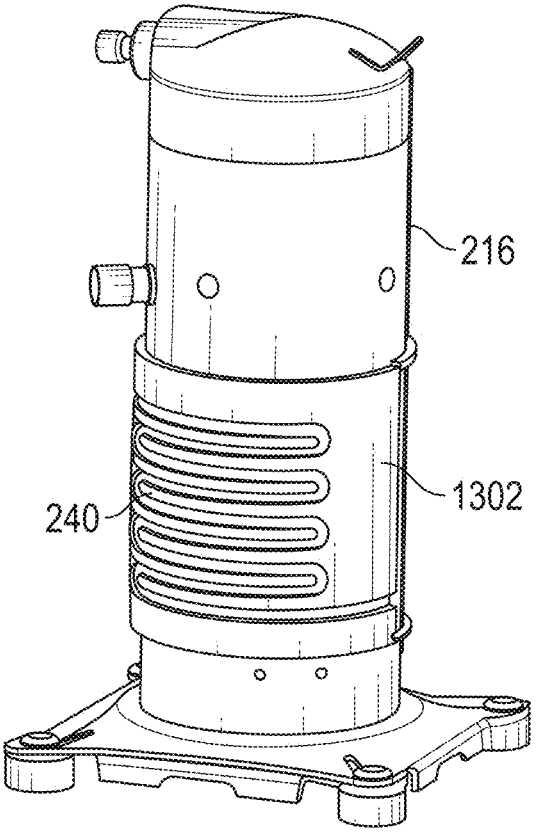
FIG. 13 illustrates a perspective view of the compressor with a cast metal heat sink and a heat exchange pipe section in accordance with one or more embodiments of the present disclosure.

FIG. 13 illustrates a perspective view of the compressor 216 with a metal heat sink 1302 and the heat exchange pipe section 240 in accordance with one or more embodiments of the present disclosure.

In some embodiments, the metal heat sink 1302 may be wrapped around the compressor 216 and detachably fastened by known methods, a non-limiting example of which includes pipe fasteners. In some embodiments, the metal heat sink 1302 may be bolted onto compressor 216.

In operation, the metal heat sink 1302 extracts heat from the compressor 216 and transfers the extracted heat to the heat exchange pipe section 240.

The embodiments as shown in FIG. 13 may increase the case of retrofitting heat exchange pipe around an existing compressor. In particular, as the metal heat sink 1302 and the heat exchange pipe section 240 are incorporated into a unitary item, when the metal heat sink 1302 is affixed to an existing compressor 216, the heat exchange pipe section 240 is additionally attached thereto.

It should be noted that in the embodiments discussed above, a condensate pump pumps condensate to a vaporizer, which vaporizes the condensate. The vaporized condensate is then blown out from the air conditioning unit by a discharge fan. However, in certain embodiments, the condensate may be pumped to an external area of the air conditioning unit. For example, in some instances, the condensate may be pumped to a sink or drain that is external to the air conditioning unit.

In typical air conditioning units, when a defrost procedure is performed to remove frost from the outdoor heat exchanging coils, the resulting condensate drips from the outdoor portion of the air conditioning unit. Further, in some instances, the condensate may form icicles on the outside of the air conditioning unit. These icicles may be problematic for passersby or property if they detach from the air conditioning unit and fall. To address these issues, in accordance with one or more embodiments of the present disclosure, when a defrost procedure is performed to remove frost from the outdoor heat exchanging coils, the resulting condensate collected in a drip pan is pumped to a vaporizer, and the vapor is ejected from the air conditioning unit. As such, there is no dripping of the condensate from the air conditioning unit and there are no icicles forming on the air conditioning unit from the condensate.

It should be apparent that the foregoing relates only to certain embodiments of the present disclosure and that numerous changes and modifications may be made herein by one of ordinary skill in the art without departing from the general spirit and scope of the disclosure.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A system comprising:

a compressor configured to pump a refrigerant;

a heat exchanging coil configured to receive the refrigerant from the compressor in a defrosting mode and melt ice formed on the heat exchanging coil into condensate;

a condensate pump; and a water transport system, wherein the condensate pump is configured to pump the condensate via the water transport system, wherein a heat exchanging pipe section of the water transport system contacts an outer surface of the compressor such that residual heat from the compressor heats the condensate being pumped by the condensate pump, and wherein the heat exchanging pipe section comprises a plurality of vertical pipes extending parallel to one another and vertically along the outer surface of the compressor.

2. The system of claim 1, further comprising a drip pan arranged to receive the condensate from the heat exchanging coil, wherein the condensate pump is configured to pump the condensate from the drip pan.

3. The system of claim 2, wherein the water transport system further comprises:

an inlet pipe section disposed in the drip pan and connected to the heat exchanging pipe section; and an outlet pipe section connected to the heat excanging pipe section.

4. The system of claim 1, wherein the heat exchanging pipe section further comprises:

a top circumferential pipe extending around the compressor and connected to the plurality of vertical pipes; and a bottom circumferential pipe extending around the compressor and connected to the plurality of vertical pipes.

5. The system of claim 3, further comprising a filter disposed about at least a portion of the length of the inlet pipe section disposed within the drip pan and configured to filter the condensate.

6. The system of claim 3, wherein the heat exchanging pipe section encircles the compressor.

7. The system of claim 3, wherein the inlet pipe section has a first open end disposed within the drip pan.

8. The system of claim 1, further comprising a flashing connected to the compressor and covering the heat exchanging pipe section, wherein the flashing is configured to sink heat from the compressor to the heat exchanging pipe section.

9. The system of claim 1, further comprising:

a vaporizer, wherein the condensate pump is configured to pump the condensate to the vaporizer, and wherein the vaporizer is configured to convert the condensate to vapor.

10. The system of claim 9, further comprising a fan configured to blow the vapor.

11. The system of claim 9, wherein the vaporizer comprises an ultrasonic atomizer.

12. The system of claim 9, further comprising a controller configured to: instruct a reversing valve to shuttle the refrigerant as a compressed gas from the compressor to the heat exchanging coil in the defrosting mode, instruct the condensate pump to operate, and instruct the vaporizer to operate.

13. The system of claim 12, wherein the controller is configured to instruct the condensate pump to operate for (i) a first predetermined period of time and (ii) a second predetermined period of time after instructing the reversing valve to provide the refrigerant as the compressed gas to the heat exchanging coil in the defrosting mode.

14. The system of claim 1, further comprising a filter configured to filter the pumped condensate.

15. A system comprising:

a compressor configured to pump a refrigerant;

a heat exchanging coil configured to receive the refrigerant from the compressor in a defrosting mode and melt ice formed on the heat exchanging coil into condensate;

a vaporizer:

a condensate pump; and a water transport system, wherein the condensate pump is configured to pump the condensate via the water transport system, wherein a portion of the water transport system is disposed about the compressor such that residual heat from the compressor heats the condensate being pumped by the condensate pump, wherein the condensate pump is configured to pump the condensate to the vaporizer, and wherein the vaporizer is configured to convert the condensate to vapor.

16. The system of claim 15, wherein the portion of the water transport system contacts an outer surface of the compressor.

17. A method of operating a system, the method comprising:

operating a heat exchanging coil in a defrosting mode to melt ice formed on the heat exchanging coil into condensate; and pumping, via a condensate pump and a water transport system, the condensate, wherein a heat exchanging pipe section of the water transport system contacts an outer surface of a compressor such that residual heat from the compressor heats the condensate being pumped by the condensate pump, and wherein the heat exchanging pipe section comprises a plurality of vertical pipes extending parallel to one another and vertically along the outer surface of the compressor.

18. The method of claim 17, further comprising filtering the condensate entering the water transport system.

19. The method of claim 17, further comprising converting the condensate to vapor.

20. The method of claim 19, further comprising discharging the vapor outside.

* * * * *